US006899297B1

(12) United States Patent
Sand et al.

(10) Patent No.: US 6,899,297 B1
(45) Date of Patent: May 31, 2005

(54) MISSILE FIRE CONTROL SYSTEM

(75) Inventors: Richrad J. Sand, Torrance, CA (US); Michael L. Wells, Hawthorne, CA (US); Melvin A. Olson, Rancho Cucamonga, CA (US); Eric B. Sutton, Los Angeles, CA (US)

(73) Assignee: Raytheon Company, Waltham, MA (US)

( * ) Notice: Subject to any disclaimer, the term of this patent is extended or adjusted under 35 U.S.C. 154(b) by 1826 days.

(21) Appl. No.: 08/577,992

(22) Filed: Dec. 22, 1995

(51) Int. Cl.[7] ..... F41G 7/32
(52) U.S. Cl. ..... 244/3.12; 365/153
(58) Field of Search ..... 244/3.13, 3.11, 244/3.12; 356/153, 141.1

(56) References Cited

U.S. PATENT DOCUMENTS

| | | | | | |
|---|---|---|---|---|---|
| 3,718,927 | A | * | 2/1973 | Howard et al. | 342/77 |
| 4,136,343 | A | * | 1/1979 | Heffner et al. | 244/3.19 |
| 4,155,096 | A | * | 5/1979 | Thomas et al. | 358/125 |
| 4,319,839 | A | * | 3/1982 | Durran | 356/153 |
| 4,385,834 | A | * | 5/1983 | Maxwell, Jr. | 356/153 |
| 4,486,756 | A | * | 12/1984 | Peregrim et al. | 342/77 |
| 4,646,094 | A | * | 2/1987 | Stevenson | 342/155 |
| 5,074,491 | A | * | 12/1991 | Tyson | 244/3.11 |
| 5,107,269 | A | * | 4/1992 | Labozzetta | 342/77 |

* cited by examiner

*Primary Examiner*—Michael J. Carone
(74) *Attorney, Agent, or Firm*—John E. Gunther; Leonard A. Alkov; Karl A. Vick

(57) ABSTRACT

The need in the art is addressed by the improved missile fire control system of the present invention. In the illustrative embodiment, the inventive system is adapted for use with TOW missile systems and includes a telescope cluster assembly (10) for generating target position signals (18,20). A digital error detector (22') receives and processes target position signals (18,20) from the telescope cluster assembly (10). The processed signals (24,26) are then fed to a stabilization control amplifier (50), where a microcontroller (56) steps through a set of instructions eliminate angular noise from the target position signals (24,26). The stabilization control amplifier (50) subsequently provides feedback to the telescope cluster assembly (10) for adjusting the line-of-sight in the telescope cluster assembly (10). Software instructions for the microcontroller (56) and constant reference data are stored in the microcontroller memory (not shown). An erasable programmable logic device (58) is used to output discreet signals for controlling mirror positioning. The inventive set of instructions includes sampling azimuth and elevation error signals (70); calculating the average of said azimuth and elevation error signals (72); performing a comparison of the average to a specified boresight limit (74); performing calculations on the averages in response to information received from the output of the comparison for determining motor runtimes (76,78,80,82,84); and repeating the above steps as necessary for obtaining azimuth and elevation signals within a specified limit.

16 Claims, 3 Drawing Sheets

MISSILE FIRE CONTROL SYSTEM

This invention was made with government support under Contract No. F0406-90-0004 awarded by the Department of the Air Force. The Government has certain rights in this invention.

BACKGROUND OF THE INVENTION

1. Field of Invention

This invention relates to weapons fire control systems. Specifically, the present invention relates to systems for effecting boresight alignment for TOW (tube launched, optically tracked, wire-guided) missile fire control systems.

2. Description of the Related Art

The there is an ongoing need to increase the accuracy and performance of missile fire control systems. Efforts to obtain greater target percentages have led to the development of devices such as laser target designators. As targeting hardware becomes more sophisticated, the need increases for advanced electrical subsystems. This is particularly true of the TOW missile system. TOW missiles are relatively inexpensive, tube-launched, optically tracked wire-guided missiles. The electrical subsystems of conventional TOW missiles are not designed to be compatible with new devices such as laser target designators. In addition, the analog fire control circuitry for the TOW missile is over 20 years old. As a result, components necessary for replacement are becoming increasingly difficult to obtain.

In addition, conventional TOW fire control circuitry is plagued with noise. This noise, referred to as angular noise, obscures important signals in the feedback control loop which are largely responsible for missile accuracy and boresight alignment.

Efforts to reduce the effects of the angular noise led to analog filtering of the noise during boresight alignment. Noise filtering was limited due to stability requirements of the boresight control loop. In the existing fire control electronics, angular noise is still responsible for as much as 5.5 to 12.4 microradians of uncertainty.

Hence, a need exists in the art for a versatile TOW fire control system which reduces the effects of angular noise and is compatible with current technology.

SUMMARY OF THE INVENTION

The need in the art is addressed by the improved missile fire control system of the present invention. In the illustrative embodiment, the inventive system is adapted for use with TOW missile systems and includes a conventional telescope cluster assembly for generating target position signals. The telescope cluster assembly includes a mirror for directing the line-of-sight of the telescope and a detector for providing line-of-sight error signals. A motor is provided for controlling the mirror in response to a control signal provided by a processor. The processor operates on the line-of-sight error signals to eliminate angular noise and to provide the control signal in response thereto.

In a more specific implementation, a digital error detector receives and processes target position signals from the telescope cluster assembly. The processed signals are then fed to a stabilization control amplifier, where during boresight alignment, a microcontroller steps through a set of instructions that eliminate angular noise from the target position signals. The stabilization control amplifier subsequently provides feedback to the telescope cluster assembly for adjusting the line-of-sight in the telescope cluster assembly.

The digital error detector converts azimuth and elevation error signals into azimuth and elevation mirror steering signals and then directs the steering signals through an analog interface (not shown). The azimuth and elevation mirror steering signals are then multiplexed onto one analog signal path by a two to one multiplexer in the stabilization control amplifier. The single analog path is then converted to a digital path by an analog to digital converter.

The digital signals are then processed by the microcontroller that filters noise from the mirror steering signals. Software instructions for the microcontroller and boresight alignment offset correction information are stored in digital memory for the microcontroller. An erasable programmable logic device provides discreet outputs to control solid state relays that apply motor drive current for repositioning a mirror during boresight alignment. The software instructions include sampling azimuth and elevation error signals; calculating the average of said azimuth and elevation error signals; performing a comparison of the average to a specified boresight limit; performing calculations on the averages in response to information received from the output of the comparison for determining motor runtimes; and repeating the above steps as necessary for obtaining azimuth and elevation signals within a specified limit.

DESCRIPTION OF THE INVENTION

Figure 1:
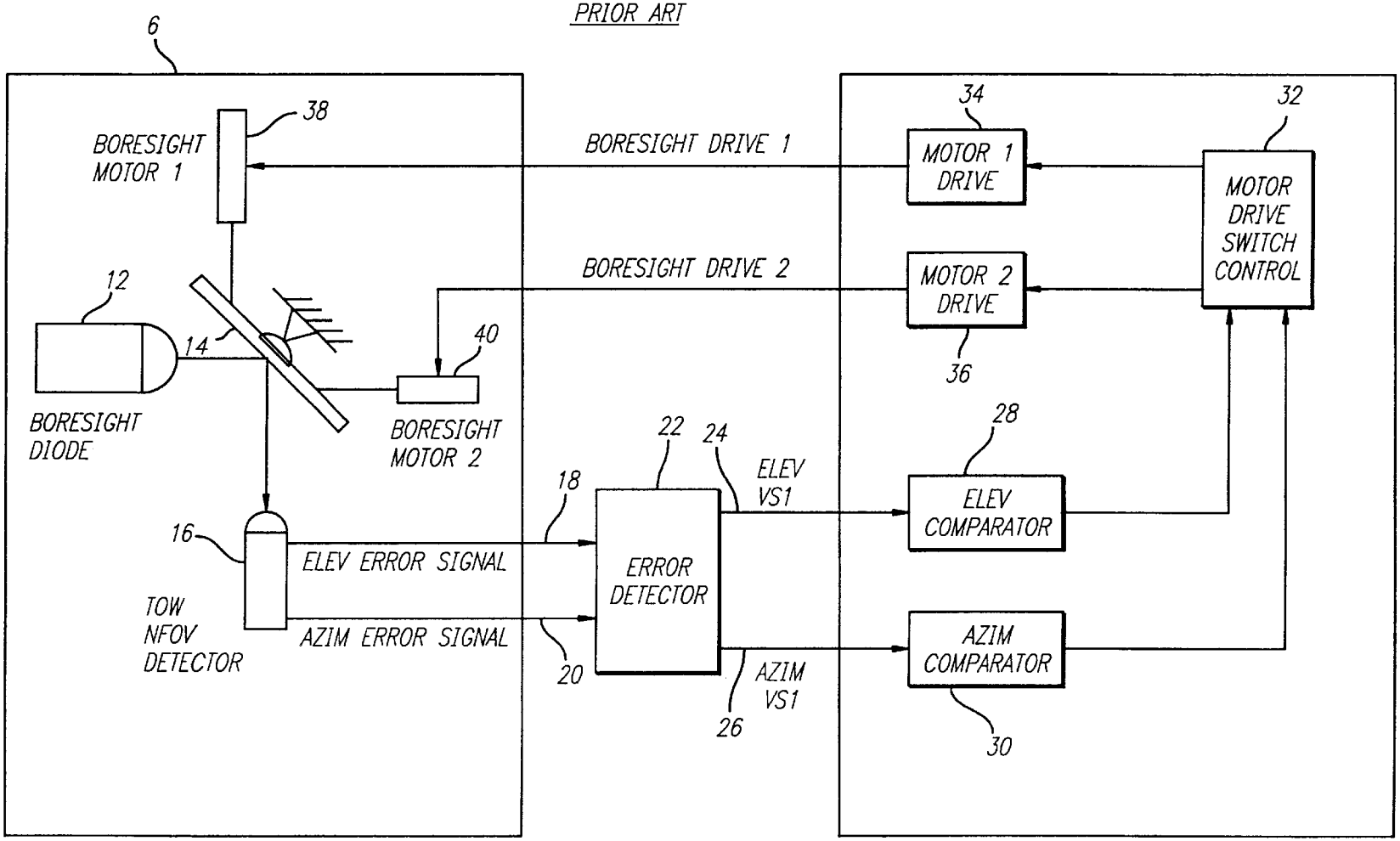
FIG. 1 PRIOR ART
FIG. 1 is a block diagram of a conventional fire control system showing TOW boresight electronics and optics.

Illustrative embodiments and exemplary applications will now be described with reference to the accompanying drawings to disclose the advantageous teachings of the present invention.

The invention is described below in reference to the accompany drawings in which like reference numerals denote like parts. While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

The following review of the operation of a traditional TOW missile firing electronics system is intended to facilitate an understanding of the present invention. Conventional TOW missile fire control systems have a boresight mode of operation and a missile tracking mode of operation. In the boresight mode, the firing electronics facilitate alignment of internal optics in the telescope cluster assembly. In missile tracking mode, the gunner's line-of-sight is placed on the intended target. The firing electronics monitor the missile position with respect to the gunner's line-of-sight and generate missile steering commands to maintain the missile on or near the line-of-sight.

FIG. 1 is a block diagram of a conventional fire control system showing TOW boresight electronics and optics. The telescope cluster assembly 10 is shown housing various optical and electronics devices. A boresight laser diode 12 outputs an image beam that impinges on an opaque reticle plate (not shown) that contains a transparent pinhole at its center. The pinhole represents the center of the visual reticle for the targeting optical system. The portion of the laser beam that passes through the reticle pinhole is reflected off a folding mirror 14. The reflected beam is received by a TOW narrow field of view (NFOV) detector 16. The angle of the reflected beam with respect to the line-of-sight of the detector 16 is used to generate time dependent signals from which the alignment error can be obtained by subsequent processing. These signals are output form the NFOV detector 16 as an elevation error signal 18 and an azimuth error signal 20. The error detector 22 processes the time dependent elevation and azimuth error signals 18,20 and outputs a direct current (DC) analog signal referred to as the elevation VS1 signal 24, and a direct current (DC) analog signal referred the azimuth VS1 signal 26. The analog signals 24,26 may represent the missile displacement from the gunner's line-of-sight during a missile flight, or the angular error between the boresight reticle and the NFOV detector 16 during boresight alignment. In existing TOW fire control systems both the elevation VS1 24 and the azimuth VS1 26 signals are contaminated with 20 Hertz sampling noise which is referred to as angular noise. A low pass filter (not shown) is applied to the azimuth VS1 signal 26, and the elevation VS1 signal 24. Although the low pass filter (not shown) is effective in filtering out higher frequency noise such as radio waves, the low pass filter (not shown) does not effectively filter angular noise. Analog filters capable of filtering the 20 Hertz angular tend to be extremely bulky, and they create stability problems when inserted into the system.

In the boresight mode, the elevation 24 and azimuth 26 VS1 signals are compared to DC reference voltages (not shown) by an elevation comparator 28 and an azimuth comparator 30 respectively. If the signals are outside the voltage range defined by the comparator references, the output of the comparator transitions to the "ON" state. If both signals 24,26 are within the specified voltage range, the output of the comparator remains in the "OFF" state.

During boresight alignment, the output state of the comparators 28,30 determines the status of the motor drive switch control 32. If the output of both comparators 28,30 are in the "OFF" state, the motor drive switch control 32 is inactive. If one or both of the comparator outputs is in the "ON" state, the motor drive switch control 32 is active and selects one or both of the motor 1 drive 34 or the motor 2 drive 36.

The first motor drive 34 activates a first boresight motor 38 and the second motor drive 36 then activates a second boresight motor 40 in response to signals received from the switch control 32. The first boresight motor 38 and the second boresight motor 40 are located in the telescope cluster assembly 10 and control the angular position of the mirror 14. The mirror 14 moves to compensate for misalignment of the reticle line-of-sight with respect to the detector line-of-sight.

If the new mirror positioning fails to reduce the VS1 signals 24,26 then feedback through the switch 32 and the motors 38,40 continues until it times out. If the missile command amplifier (MCA) (not shown) does not receive a boresight alignment "test pass" signal within 60 seconds of the test initiation, the MCA (not shown) assumes a "test fail". The MCA (not shown) then terminates the test, and proceeds with a subsequent system test.

In missile tracking mode, the conventional TOW fire control system operates in a similar manner to the boresight mode with several exceptions. First, the NFOV detector 16 receives a signal from a beacon in the missile (not shown) instead of the boresight diode 12. The elevation VS1 signal 24 and the azimuth VS1 signal 26 output by the NFOV detector 16 now represent the misalignment of the missile (not shown) with respect to the reticle (not shown) in the telescope cluster assembly 10. The analog error detector 22 processes the elevation error signal 18 and the azimuth error signal 20 and outputs the elevation steering signal 24 and the azimuth steering signal 26 respectively. In missile tracking mode, the signals 24, 26 are used to steer the missile (not shown) rather than the mirror 14. The signals 24,26 represent the displacement of the missile with respect to the gunner's line-of-sight as determined by the position of the reticle (not shown). The steering signals 24,26 are routed through a coordinate transform (not shown) in order to place the signals 24, 26 in the missile coordinate system. The signals 24,26 are then routed to the MCA (not shown) where they are transformed from DC analog signals into frequency modulated signals for use in directing the missile toward the line-of-sight.

Figure 2:
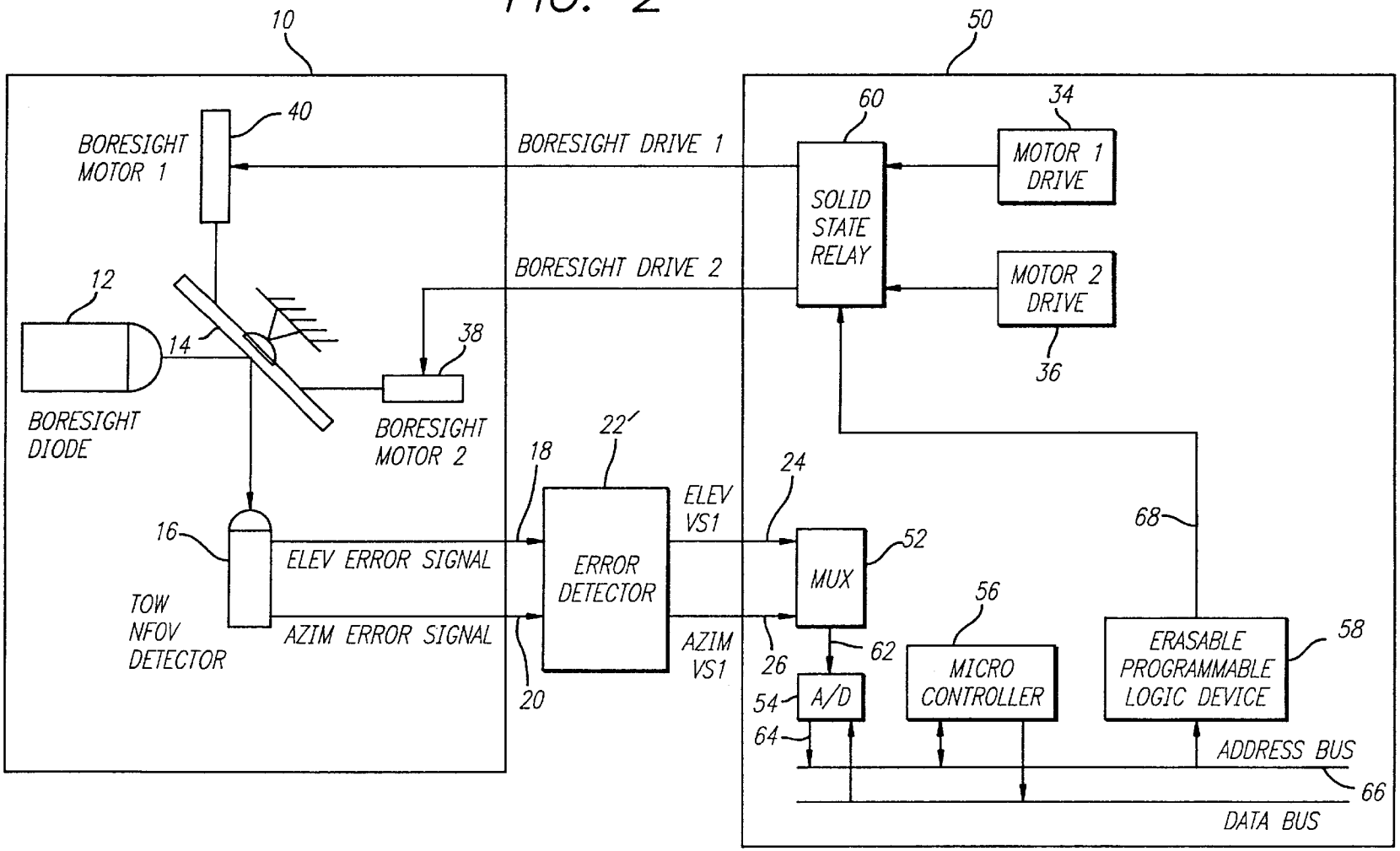
FIG. 2 is a block diagram of the fire control system of the present invention.

FIG. 2 is a block diagram of the fire control system of the present invention. The telescope cluster assembly 10 and its various components remain the same as the prior art. Through the use of an advanced digital stabilization control amplifier 50, the angular noise contaminating elevation steering signal 24 and azimuth steering signal 26 is greatly reduced. The reduction in noise around the steering signals results in greatly improved accuracy of the TOW missile boresight servo.

Error signals generated in the telescope cluster assembly 10 due to boresight error, or misalignment of the missile with respect to the gunner's line-of-sight are passed on to the digital error detector 22'. In the present specific embodiment, although the detector 22' is a digital processor, the interface (not shown) between the digital stabilization control amplifier 50 and the error detector remains analog. The analog interface serves to facilitate backward compatibility with existing TOW fire control systems and boresight servos. The elevation steering signal 24 and the azimuth steering signal 26 output from the detector 22' are routed to the stabilization control amplifier 50 of the present invention.

In the present specific embodiment, the inventive stabilization control amplifier 50 includes an analog multiplexer (MUX) 52, a analog to digital converter 54, a microcontroller 56, an erasable programmable logic device (EPLD) 58, a solid state relay 60, the first motor drive 34 and the second motor drive 36. The VS1 signals 24,26 are routed to the improved stabilization control amplifier 50 where they multiplexed onto one analog path provided at the output 62 of the MUX 52. Signals output from the MUX 52 are subsequently converted to digital signals by the analog to digital converter 54. The output 64 of the analog to digital converter 54 represents the digitized elevation VS1 signal 24 and azimuth VS1 signal 26.

The output 64 is then selectively routed to the microcontroller 56 and the EPLD 58 in response to commands received from the microcontroller 56. The microcontroller is used to execute a set of commands encoded in software stored in the microcontroller memory (not shown). The stored commands are used to filter noise from the VS1 signals 24,26 while maintaining a stable closed loop feedback system during boresight alignment. The system is useful in re-boresighting optics in the telescope cluster assembly 10 in response to error signals generated by misalignment of the reticle line-of-sight with respect to the detector line-of-sight.

During boresight and after noise is filtered from the VS1 signals 24,26 by the microcontroller 56, the amplitudes of the filtered VS1 signals 24,26 are compared to values stored in the microcontroller memory (not shown). If the filtered VS1 signals exceed any of the stored values, appropriate discreet signals 68 are output from the EPLD 58 to the solid state relay 60. The solid state relay 60 activates the motors 38,40 via the motor 1 drive 34 and the motor 2 drive 36 respectively, in response to the signals 68 received by the solid state relay 60. The operation of the first boresight motor 38 and the second boresight motor 40 and the movement of the mirror remains the same as in the prior art. If the new mirror positioning fails to reduce the VS1 signals 24,26, then the motor drives 34,36 are applied until the boresight test passes or until a 60 time-out occurs. As in the prior art, the 60 second time-out is controlled by the MCA (not shown). If the filtered VS1 signals are both within the specified stored limits, the boresight alignment process is finished and a "test pass" is output to the MCA (not shown), and none of the motors 38,40 are activated.

Figure 3:
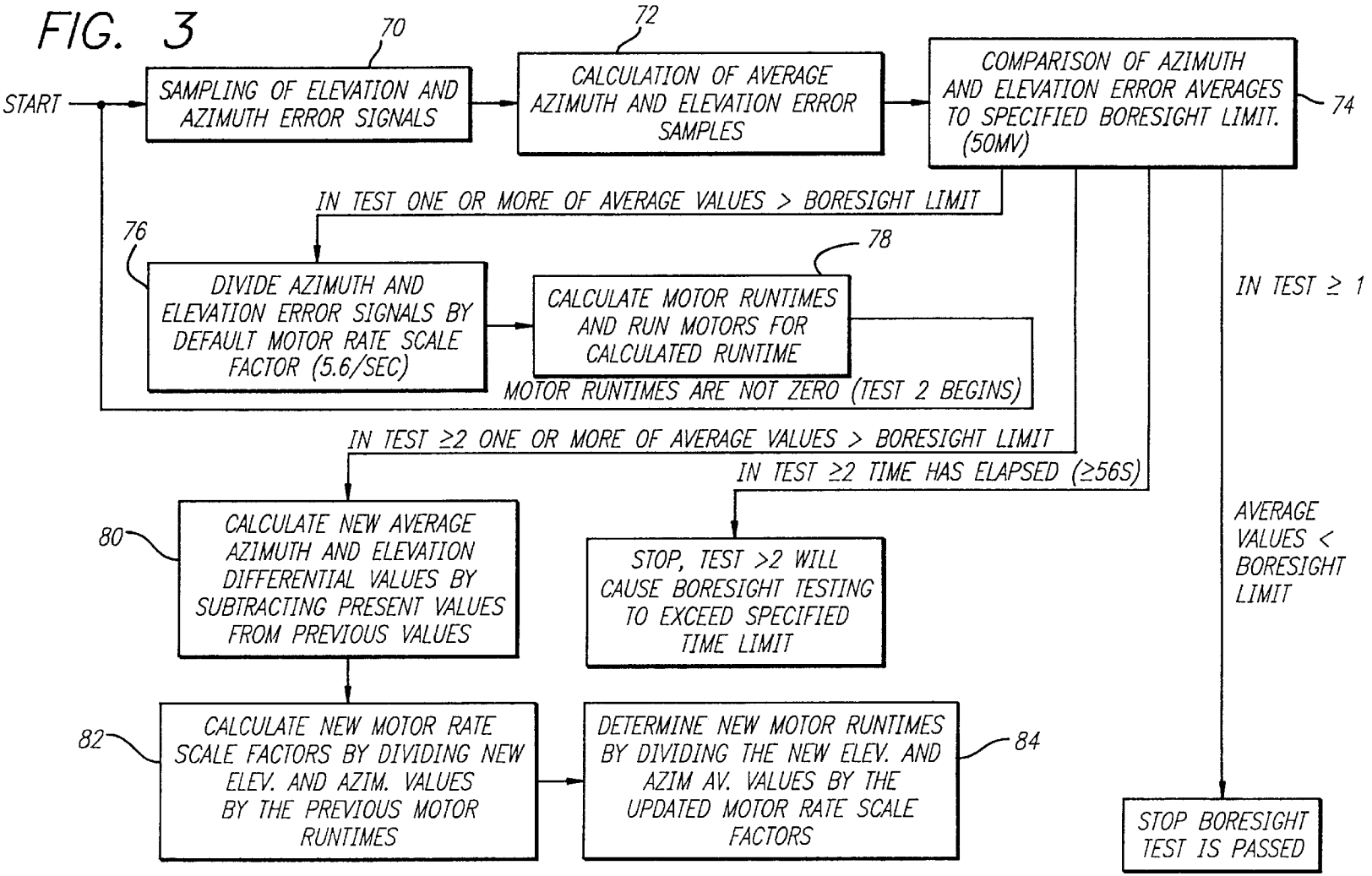
FIG. 3 is a flow diagram indicating error filtering steps performed by the boresight electronics of the present invention.

FIG. 3 is a flow diagram indicating error filtering steps performed by the boresight electronics of the present invention. The steps are performed by software running on the microcontroller 56.

In a first test, samples are taken of the azimuth VS1 signal 26 and the elevation VS1 signal 24 in a sampling step 70. In a specific embodiment, 40 samples of each signal are taken. In a subsequent averaging step 72, averages of the error signal samples are computed. The averaging computation is performed with the control loop open to eliminate the stability problems of the control loop. In the averaging step, the 20 Hertz AC angular noise is removed from the DC elevation VS1 signal 24, and the DC azimuth VS1 signal 26. The removal of the angular noise is possible because the average of the angular noise is zero. In a specific embodiment, the sampling step 70 together with the averaging step 72 is performed over a period of two seconds for allowing sufficient time for the angular noise to be eliminated from the VS1 signals 24,26. The following comparing step 74 compares the average value of the samples to a specified boresight limit. In a specific embodiment, the boresight limit is 50 millivolts. The results of the comparison determine which and in what order subsequent steps will be performed.

If, in the first test, both of the azimuth and elevation average values are less than the specified boresight limit, then testing is stopped, as the boresight testing was a success.

If, in the first test, one or more of the azimuth VS1 signal 26 and the elevation VS1 signal 24 exceed the specified boresight limit, then a dividing step 76 is completed. In the dividing step 76, the azimuth and elevation error signals 26,24 are each divided by the default motor rate scale factor which is 5.6 volts per second in a specific embodiment. The resulting values are used in an actuating step 78 to determine the runtimes for the first motor 38 and the second motor 40. The motors are then run for the specified time periods.

After the motors 38,40 are run for the specified period of time, a second test begins. In the second test, the sampling step 70, the averaging step 72 and the comparing step 74 are repeated.

If a specified testing time has elapsed, the present boresight testing stops. In a specific embodiment, the specified time is 56 seconds. This is because the time allotted for testing is 60 seconds, and the first 3 seconds are used for a different test. If 56 seconds have elapsed, then a subsequent step will cause the total testing time to exceed the 60 second limit.

If either of the averages of the azimuth error samples and the elevation error samples exceed the specified boresight limit in the current second test, new averages are calculated in a subtracting step 80. In the subtracting step 80, the new average azimuth and elevation averages are calculated by subtracting present azimuth and elevation averages from previous azimuth and elevation averages. A factor calculating step 82 immediately follows. In the factor calculating step 82, new motor rate scale factors are calculated by dividing the new azimuth and elevation average values by the previous motor runtimes. Using calculating step 82 permits the system to estimate the actual motor rate scale factors which can then be used in place of the default values which are assumed values that do not account for system to system variation and the effects of temperature. Immediately following step 82 is a motor runtime step 84. In the motor runtime step 84, the new motor runtimes are determined by dividing the new azimuth and elevation average values by the updated motor rate scale factors calculated in the factor calculating step 82. After step 84 is completed, control returns to the sampling step 70. If the specified testing time has not elapsed and one or more of the azimuth and elevation average values exceed the specified boresight limit, then the subtracting step 80, the factor calculating step 82 and the motor runtime step 84 are repeated. If the specified testing time has not elapsed and the azimuth and elevation average values do not exceed the specified boresight limit, boresight testing is stopped, as the testing was a success. If the specified testing time has elapsed, boresight testing is stopped, and the boresight test is considered a "fail" as the testing ran out of time.

Whether or not a specific boresight testing sequence is in the first test, second test or greater test may be handled using a simple counter variable. Those skilled in the art will appreciate that other counting mechanisms may be used for this purpose without departing from the scope of the present.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly,

What is claimed is:

1. An improved missile fire control system comprising:

telescope means for receiving electromagnetic energy and providing an electrical signal in response thereto having an angular noise component, said telescope means including:

mirror means for directing the line-of-sight of the telescope means; and means for providing line-of-sight error signals;

motor means for controlling said mirror means in response to a control signal; and means for processing said line-of-sight error signals to eliminate said angular noise and to provide said control signal in response thereto, said means for processing further including:

means for averaging said line-of-sight error signals to provide an average signal; and means for calculating said average signal with an open-loop.

2. The invention of claim 1 wherein said means for providing line-of-sight error signals includes means for providing an elevation error signal and an azimuth error signal.

3. The invention of claim 1 wherein said means for averaging includes means for averaging said elevation error signal and means for averaging said azimuth error signal to provide averaged elevation and azimuth error signals without angular noise respectively.

4. The invention of claim 1 wherein said means for processing includes means for providing a comparison of said average signal to a threshold.

5. The invention of claim 4 wherein said means for processing includes memory means for storing position signal information and comparison reference values for said comparing means.

6. The invention of claim 4 wherein said means for processing includes means for performing calculations on said average signal and providing said control signal in response thereto.

7. The invention of claim 6 wherein said means for performing calculations includes means for dividing said azimuth error signal and said elevation error signal by a motor rate scale factor to determine motor runtimes.

8. The invention of claim 7 wherein said means for performing calculations further includes means for calculating a new average azimuth error and a new elevation error signal by subtracting average values obtained in a second test from average values obtained in a first test.

9. The invention of claim 8 wherein said means for performing calculations further includes means for updating said motor runtimes by dividing said new azimuth error and elevation error signals by new motor rate scale factors.

10. The invention of claim 8 wherein said means for performing calculations further includes means for calculating new motor rate scale factors during said second test by dividing said new average azimuth error and elevation error signals by said motor runtimes obtained in said first test.

11. The invention of claim 8 wherein said means for processing includes feedback means for providing said control signal to said motor means.

12. The invention of claim 11 wherein said feedback means includes said microcontroller connected to an erasable programmable logic device.

13. The invention of claim 11 wherein said motor means includes a motor for controlling elevation and azimuth of said line-of-sight of said mirror means in response to said control signal.

14. An improved missile fire control system comprising:

telescope means for receiving electromagnetic energy and providing an electrical signal in response thereto having an angular noise component, said telescope means including:

mirror means for directing the line-of-sight of the telescope means; and means for providing line-of-sight error signals;

motor means for controlling said mirror means in response to a control signal; and means for processing said line-of-sight error signals to eliminate said angular noise and to provide said control signal in response thereto, said means for processing further including:

means for averaging said line-of-sight error signals to provide an average signal, said means for averaging including means for calculating said average signal with an open-loop;

means for providing a comparison of said average signal to a threshold;

memory means for storing position signal information and comparison reference values for said comparing means;

means for performing calculations on said average signal and providing said control signal in response thereto, said means for performing calculations including means for dividing said azimuth error signal and said elevation error signal by a motor rate scale factor to determine motor runtimes, said means for performing calculations further including:

means for calculating a new average azimuth error and a new elevation error signal by subtracting average values obtained in a second test from average values obtained in said first test; and means for updating said motor runtimes by dividing said new azimuth error and elevation error signals by said new motor rate scale factors.

15. An improved missile fire control system comprising:

telescope means for receiving electromagnetic energy and providing an electrical signal in response thereto having an angular noise component, said telescope means including:

mirror means for directing the line-of-sight of the telescope means; and means for providing line-of-sight error signals;

motor means for controlling said mirror means in response to a control signal; and means for processing said line-of-sight error signals to eliminate said angular noise and to provide said control signal in response thereto, said means for processing further including:

means for averaging said line-of-sight error signals to provide an average signal, said means for averaging including means for calculating said average signal with an open-loop;

means for providing a comparison of said average signal to a threshold;

memory means for storing position signal information and comparison reference values for said comparing means;

means for performing calculations on said average signal and providing said control signal in response thereto, said means for performing calculations including means for dividing said azimuth error signal and said elevation error signal by a motor rate scale factor to determine motor runtimes, said means for performing calculations further including:

means for calculating a new average azimuth error and a new elevation error signal by subtracting average values obtained in a second test from average values obtained in said first test; and means for calculating new motor rate scale factors during said second test by dividing said new average azimuth error and elevation error signals by said motor runtimes obtained in said first test.

16. An improved missile fire control system comprising:

telescope means for receiving electromagnetic energy and providing an electrical signal in response thereto having an angular noise component, said telescope means including:

mirror means for directing the line-of-sight of the telescope means; and means for providing line-of-sight error signals;

motor means for controlling said mirror means in response to a control signal; and means for processing said line-of-sight error signals to eliminate said angular noise and to provide said control signal in response thereto, said means for processing further including:

means for averaging said line-of-sight error signals to provide an average signal, said means for averaging including means for calculating said average signal with an open-loop;

means for providing a comparison of said average signal to a threshold;

memory means for storing position signal information and comparison reference values for said comparing means;

means for performing calculations on said average signal and providing said control signal in response thereto, said means for performing calculations including means for dividing said azimuth error signal and said elevation error signal by a motor rate scale factor to determine motor runtimes, said means for performing calculations further including:

means for calculating a new average azimuth error and a new elevation error signal by subtracting average values obtained in a second test from average values obtained in said first test; and feedback means for providing said control signal to said motor means, said feedback means including said microcontroller connected to an erasable programmable logic device.

* * * * *

UNITED STATES PATENT AND TRADEMARK OFFICE

CERTIFICATE OF CORRECTION

PATENT NO. : 6,899,297 B1
DATED : May 31, 2005
INVENTOR(S) : Richard J. Sand et al.

It is certified that error appears in the above-identified patent and that said Letters Patent is hereby corrected as shown below:

Title page,
Item [75], Inventors, should read -- Richard J. Sand --.

Signed and Sealed this

Eighth Day of November, 2005

JON W. DUDAS
*Director of the United States Patent and Trademark Office*